US007978020B2

(12) United States Patent
Rosenberg et al.

(10) Patent No.: US 7,978,020 B2
(45) Date of Patent: Jul. 12, 2011

(54) WAVEGUIDE JUNCTION HAVING ANGULAR AND LINEAR OFFSETS FOR PROVIDING POLARIZATION ROTATION

(75) Inventors: Uwe Rosenberg, Backnang (DE); Ulrich Mahr, Backnang (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 208 days.

(21) Appl. No.: 12/282,976

(22) PCT Filed: Mar. 27, 2006

(86) PCT No.: PCT/EP2006/061063

§ 371 (c)(1), (2), (4) Date: Jan. 26, 2009

(87) PCT Pub. No.: WO2007/110110

PCT Pub. Date: Oct. 4, 2007

(65) Prior Publication Data

US 2009/0201107 A1 Aug. 13, 2009

(51) Int. Cl.
*H01P 1/165* (2006.01)

(52) U.S. Cl. ..... 333/21 A; 333/33

(58) Field of Classification Search ..... 333/21 A, 333/157, 248, 254, 33

See application file for complete search history.

(56) References Cited

U.S. PATENT DOCUMENTS

| | | | | |
|---|---|---|---|---|
| 4,260,961 | A * | 4/1981 | Beis | 333/21 A |
| 4,311,973 | A * | 1/1982 | Nuding et al. | 333/33 |
| 6,720,840 | B2 * | 4/2004 | Bohnet | 333/21 A |

FOREIGN PATENT DOCUMENTS

| | | | |
|---|---|---|---|
| CA | 2320667 | A1 | 3/2001 |
| EP | 0247794 | A | 12/1987 |
| EP | 0392999 | A1 | 10/1990 |
| EP | 0439799 | A | 8/1991 |
| EP | 1178560 | A | 2/2002 |
| JP | 62023201 | A | 1/1987 |

* cited by examiner

*Primary Examiner* — Benny Lee

(74) *Attorney, Agent, or Firm* — Coats & Bennett, P.L.L.C.

(57) ABSTRACT

A junction (300) for connecting two waveguides having an angular offset between longitudinal symmetry axes of their cross-sections and a first linear offset of the center axes of the waveguides. The junction (300) comprises at least a first and a second transformer sections (202, 206) both having said first angular offset between longitudinal symmetry axes of their cross-sections and said first linear offset of their center axes, wherein each of said transformer sections (202, 206) has one protruded ridge (204, 208) on broad walls, wherein the first ridge (204) is mainly situated outside the cross section of the second transformer section 206 and the second ridge (208) is mainly situated outside the cross section of the first transformer section (202).

14 Claims, 5 Drawing Sheets

WAVEGUIDE JUNCTION HAVING ANGULAR AND LINEAR OFFSETS FOR PROVIDING POLARIZATION ROTATION

FIELD OF THE INVENTION

The present invention relates to a waveguide junction for connecting waveguides having a linear offset of their central axes and, additionally, a different angular alignment of their cross sections.

BACKGROUND OF THE INVENTION

Waveguide junctions used to rotate the field orientation for matching two waveguides, which are not aligned are also known as waveguide twists. In solutions known in the art and applicable in situations where the two joined waveguides exhibit an angular offset the vector of the electric field is rotated in intermediate waveguide sections with appropriate angular steps from the input to the output waveguide. Each angular step gives rise to a partial reflection of the wave depending on the angular increment. In a proper design, these partial reflections should cancel at the centre frequency; therefore the length of each section is preferably on the order of a quarter waveguide wavelength (or an odd multiple thereof). The overall bandwidth depends on the number of waveguide sections.

State-of-the-art waveguide twists are commonly based on step-twist sections. A suitable realization of this design in one piece is possible by machining the structure from the flange faces with state-of-the-art CNC milling techniques. However such a design is only possible for not more than two transformer steps, which yields substantial limitations for the achievable performance (i.e., Voltage Standing Wave Ratio, VSWR, and bandwidth). The length of the component is determined by the frequency band, i.e. the length of each transformer step is a quarter waveguide wavelength of the center frequency of the operating band. Another drawback of the prior art solutions results from the fact, that this solution would commonly exhibit an angular offset at the flange interconnections (interfaces). As a consequence, a specific (i.e. non-standard) flange sealing is necessary when using this component in sealed (pressurized) waveguide systems.

Alternative solutions known in the art are those consisting of two parts that have to be connected to form a fully functional junction. The two part format of these junctions allows for more complicated machining and, as a consequence, achieving improved performance, but manufacturing of such junctions is complicated, expensive, and time consuming. If two (or more) parts are used, they need to be combined in an appropriate way, which increases the manufacturing effort and expense. They could be assembled by screws—but such a solution needs additional sealing means in the parting plane if the component is used in a pressurized waveguide system. Another approach could be joining of the parts by soldering or brazing—however, such solutions need careful choice of the basic (and surface) material and the overall construction to meet the requirements of the additional process. Moreover the realization of the component from two (or more) parts yields additional tolerances (e.g., fitting of the parts) that may impair the optimal performance.

Hence, an improved waveguide junction would be advantageous and in particular one that has good performance characteristics and is easy for manufacturing.

SUMMARY OF THE INVENTION

Accordingly, the invention seeks to preferably mitigate, alleviate or eliminate one or more of the disadvantages mentioned above singly or in any combination.

According to a first aspect of the present invention there is provided a junction for connecting two waveguides having an angular offset between longitudinal symmetry axes of their cross-sections and a first linear offset of the center axes of the first and the second waveguides. The junction comprises at least a first transformer section and a second transformer section, both having cross-sections of substantially rectangular shape, and both having the first angular offset between longitudinal symmetry axes of their cross-sections and the first linear offset of their center axes. Each of the transformer sections has one protruded ridge on a broad wall, wherein the first ridge is mainly situated outside the cross section of the second transformer section and the second ridge is mainly situated outside the cross section of the first transformer section.

The present invention beneficially allows for interconnecting waveguides that exhibit a linear offset of their central axes and additionally a different angular alignment of their cross sections and provides compact size and easy manufacturing from one solid block of metal. Additional advantage is that high performance properties (extreme low VSWR) over broad frequency bands (up to the determined operating band of standard waveguides with typically 40% bandwidth) are achieved. The junction interfaces exhibit no angular offset to the connecting waveguides and consequently there are no problems with any standard flange interconnections (e.g. in sealed waveguide systems). In addition, the length of the manufactured part can be fitted to overall assembly requirements—it depends no longer on the operating frequency band.

BRIEF DESCRIPTION OF THE DRAWINGS

The present invention will be understood and appreciated more fully from the following detailed description taken in conjunction with the drawings in which.

DESCRIPTION OF AN EMBODIMENT OF THE INVENTION

Figure 2:
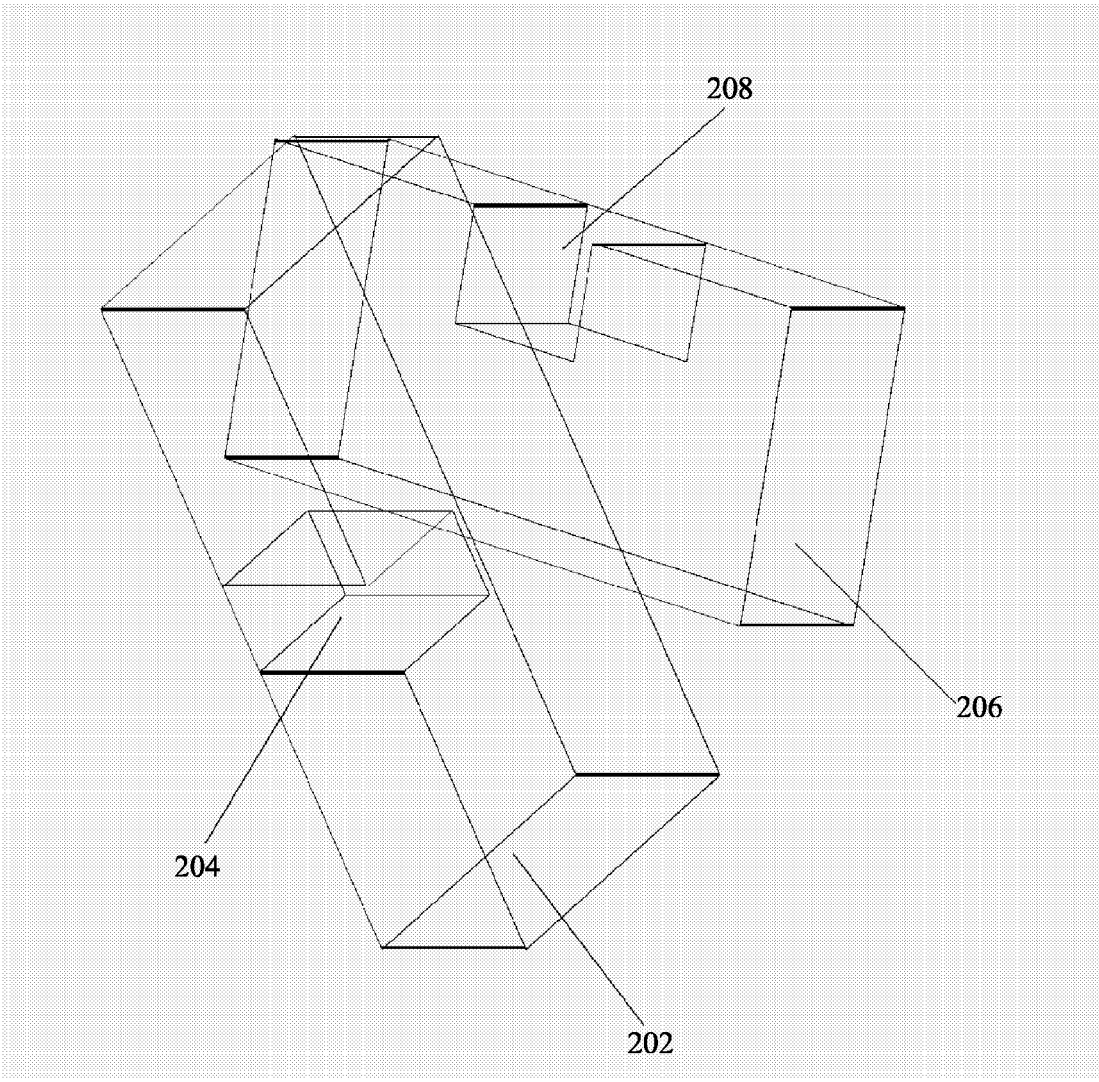
FIG. 2 is a schematic diagram illustrating transformer sections of the junction in accordance with one embodiment of the present invention.
Figure 3:
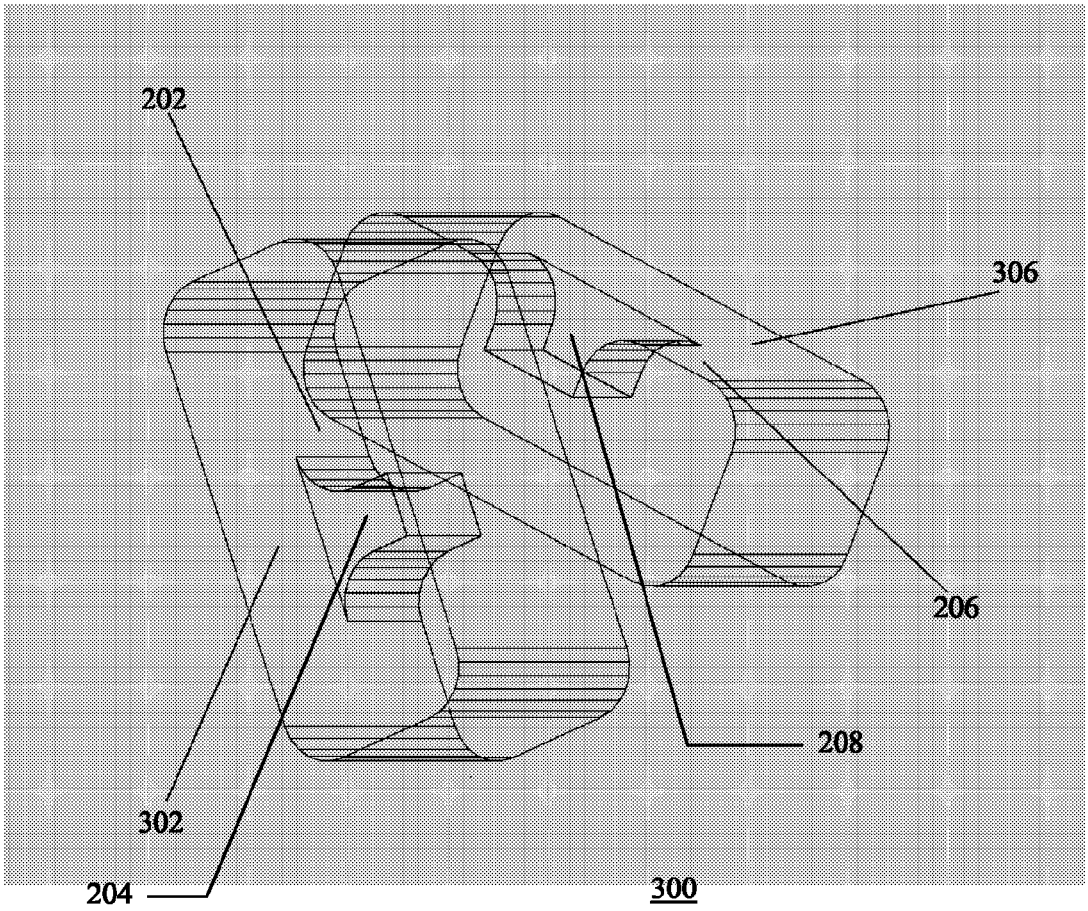
FIG. 3 is a schematic diagram illustrating a waveguide junction in accordance with one embodiment of the present invention.

With reference to FIG. 2 and FIG. 3, a junction 300 (FIG. 3) for connecting two waveguides is presented. For the sake of clarity the drawings present the invention in a very schematic way with elements and lines not essential for understanding the invention omitted.

Figure 1:
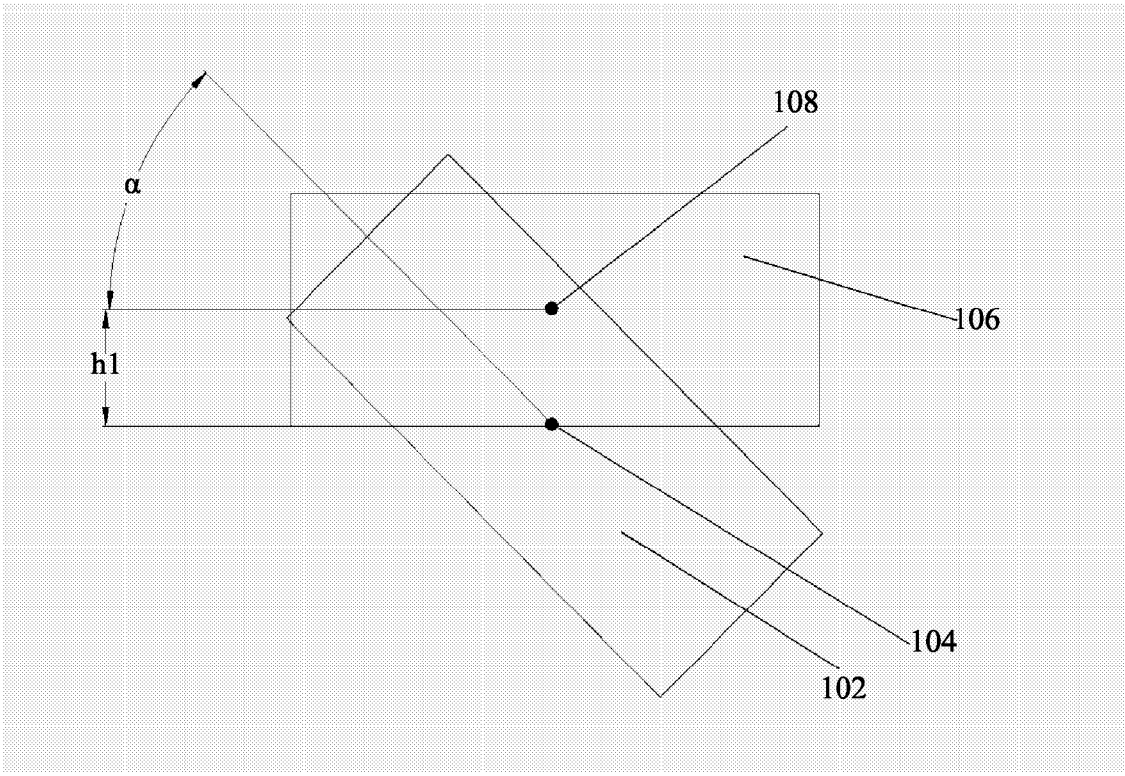
FIG. 1 is a schematic diagram illustrating linear and angular offsets of two waveguides.

FIG. 1 shows the cross sections of two waveguides (102, 106) to be interconnected and their cross sections exhibit angular, $\alpha$, and a first linear offset h1. The interconnection, to be effective, must ensure low reflections in the desired operating frequency band. In the shown example, each waveguide (102, 106) has a respective center axis (104, 108). The center axis (104) of the first waveguide (102) is located at the bottom broad wall of the second waveguide and the cross sections of the waveguides exhibit a 45° angular alignment to each other. In alternative embodiments the angular offset can be also below or above 45° and the linear offset can be such that the center axis (104) of the first waveguide (102) is not located on the broad wall of the second waveguide.

One embodiment of the novel waveguide twist according to the present invention is described below in conjunction with FIG. 1 through FIG. 3.

As seen FIGS. 2 and 3, the waveguide junction 300 comprises a first and a second transformer section 202 and 206 where a vector of electric field is rotated in order to match orientation of the two interconnected waveguides. The cross sections of the first transformer section 202 and the second transformer section 206 correspond to the cross-section of the waveguides 102 and 106 that need to be interconnected, i.e., the first linear offset h1 and the angular offset α of the transformer sections 202 and 206 are equal to the corresponding offset values of the first and second waveguides 102 and 106, as seen in FIG. 1. The waveguide transformer sections 202 and 206 have single ridges 204 and 208, as seen in FIG. 3. The first transformer section 202 has a first ridge 204 extending from its bottom broad wall into the interior of the first transformer section 202. Due to the first linear offset h1 location of the waveguides 102 and 106, the cross section of the first ridge 204 is mainly situated below the waveguide cross section of the second transformer section 206. The ridge of the second transformer section 206 (i.e. the second ridge 208) extends from its top broad wall into the interior of the second transformer section 206. Hence, the main part of the cross section of the second ridge 208 is outside the common intersecting area resulting at the interconnecting plane of the transformer sections. That is to say, the ridges 204 and 208 are situated at those broad walls, which have the least overlapping with the cross section of the other transformer section.

The cross sections of the transformer sections and the waveguides are of substantially rectangular shape.

In a preferred embodiment the ridges 204 and 208 have flat tops.

The ridges 204 and 208 yield a field concentration and distortion to obtain a suitable transformation and energy transfer at the connection of the first and second transformer sections 202 and 206.

In an empty rectangular waveguide, the vector of the electric field of the fundamental waveguide mode (TEIO-mode) is always perpendicular to the width (broad dimension) of the waveguide. The same holds for the main component of the electrical field of the fundamental mode in the first and second transformer sections 202 and 206 with ridges 204 and 208. The twist of the transmitted wave (the change of the direction of the vector of the electric field) builds on a concentration of the electrical field by the ridges 204, 208 at the angular step. In addition, the electric fields at both sides must have the same field components to obtain an appropriate coupling/transfer of the energy. These prerequisites can be obtained with symmetrical ridges for angular offsets of more than 45°.

The lengths of the transformer sections 202 and 206 are on the order of a quarter waveguide wavelength for the respective cross section. Due to the loading by the ridges 204 and 208, the waveguide wavelength of the transformer sections 202 and 206 is shorter than that of waveguides without ridges. Consequently, the transformer sections 202 and 206 become shorter compared with standard hollow waveguides.

The described structure with two transformer steps is suitable for implementations (offset half height of the waveguide dimension and angular orientation of the cross sections of 45 degree as illustrated in this embodiment) with an operating bandwidth of up to 20% (VSWR e.g. <1.06). For larger bandwidth requirements, additional transformer sections can be introduced between the interconnection of the interfaces and the inner transformer sections described above.

With reference to FIG. 3, the junction, in one embodiment of the present invention, offers the possibility to adapt its length to specific requirements, which in some circumstances would help to avoid additional waveguide hardware. This is obtained in the following way: since the transformer sections 202 and 206 have the same orientation as the interfacing waveguides 102 and 106, interface waveguide sections 302 and 306 of arbitrary lengths are located adjacent to the transformer sections 202 and 206. The first, 302, and the second, 306, interface sections do not have ridges inside and in a preferred embodiment have the same dimensions and orientation as the interfacing waveguides 102 and 106.

In one embodiment the cross-section of the first interface section 302 and the first transformer section 202 are equal and similarly cross-sections of the second interface section 306 and second transformer section 206 are equal. In an alternative embodiment the cross-sections of the first and second interface sections 302, 306 are bigger than corresponding cross-sections of the first and second transformer sections 202, 206.

The fact, that the interfaces of this new type of component exhibit the same orientation at its interfaces as the interconnecting waveguides, facilitates the implementation of standard sealing means, which are e.g., necessary for the application in pressurized waveguide systems.

Figure 4:
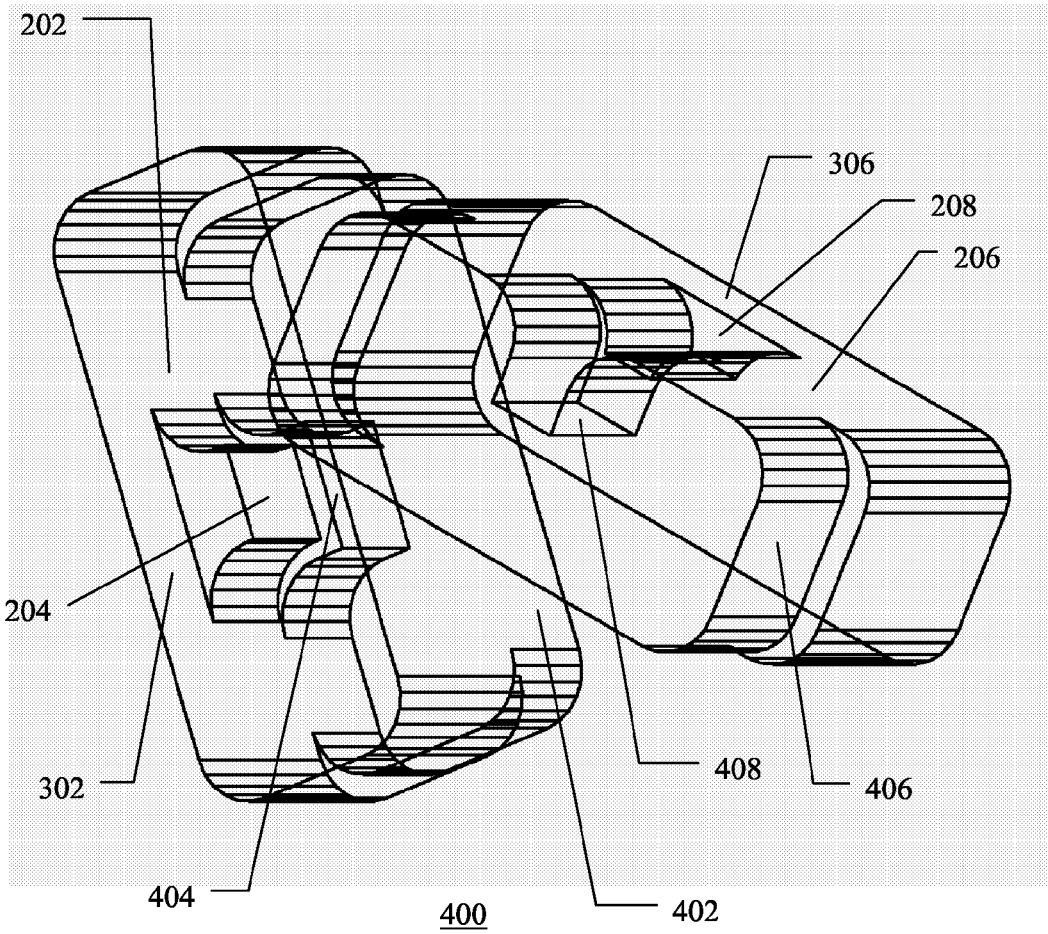
FIG. 4 is a schematic diagram illustrating a waveguide junction in accordance with one embodiment of the present invention.

The described structure with two transformer sections 202 and 206 is suitable for embodiments with an operating bandwidth of up to 20% (VSWR e.g. <1.06). For larger bandwidth requirements, additional transformer sections must be added. FIG. 4 depicts an embodiment of the invention with four transformer sections 202, 206, 402, and 406, two of which are cascaded connecting at one side of the interface waveguide and at the opposite one the other transformer sections with 45 degree alignment. As in the previous embodiment the 45 degree value is chosen for illustrative purposes only. The first and second interface sections 302, 306 can be seen in FIG. 4, as can the second ridge 208.

In this alternative embodiment the junction 400 comprises four transformer sections 202, 206, 402, 406, two on each side of the junction. A third transformer section 402 is connected to the first transformer section 202 wherein the third and first transformer sections have the same angular orientation. A fourth transformer section 406 is connected to the second transformer section 206 and the fourth and second transformer sections have the same angular orientation. The third and fourth transformer sections each have one ridge 404 and 408 located in the center of the same broad walls as in the respective first and second transformer sections 202 and 206. Preferably, dimensions of the third ridge 404 in the third transformer section 406 are greater than dimensions of the first ridge 204 and dimensions of the fourth ridge 408 in the fourth transformer section 406 are greater than dimensions of the second ridge 208. This results in geometry of the junction 400 that allows for easy manufacturing from one solid block of metal. In a preferred embodiment the ridges 204, 208, 404 and 408 have flat tops.

In a preferred embodiment, the transformer sections 202, 206, 402 and 406 have the same dimensions of cross-sections. However in alternative embodiments the cross-section of the first and second transformer sections, 202 and 206, is bigger than cross-section of the third and fourth transformer sections, 402 and 406, as it is depicted in FIG. 4. Transformation (twisting the orientation of the electric and magnetic vectors of the transmitted wave) is obtained by different dimensions of the ridges of the inner (i.e. third and fourth 402, 406) and the outer (i.e. first and second 202, 206) transformer sections. The fact that the dimensions of the ridges 404 and 408 in the third and fourth transformer sections 402 and 406, as illustrated in FIG. 4, are greater than the dimensions of the ridges in the first and second transformer sections 202 and 206, maintains favourable production properties for the junction. However, it should be noted, that in alternative embodiments the third and fourth transformer sections 402, 406 need not to have the same overall cross section dimensions as the first and second transformer sections 202, 206. In special designs a smaller cross-section of the third and fourth sections 402, 406 can be used for further performance improvements while allowing still easy manufacturing.

The solution with four transformer sections is applicable for implementations with larger bandwidth than solutions with two transformer sections. The solution with four transformer sections allows for operating bandwidth of up to 30% (VSWR e.g. <1.02), wherein the solution with two transformer sections allows for operating bandwidth of up to 20% (VSWR e.g. <1.06).

In embodiments of the present invention, where the first angular offset $\alpha$ is substantially in a range from 0° up to 60° the ridges 204, 208, 404 and 408 are located substantially at the center of the walls of the transformer sections 202, 206, 402 and 406.

Figure 5:
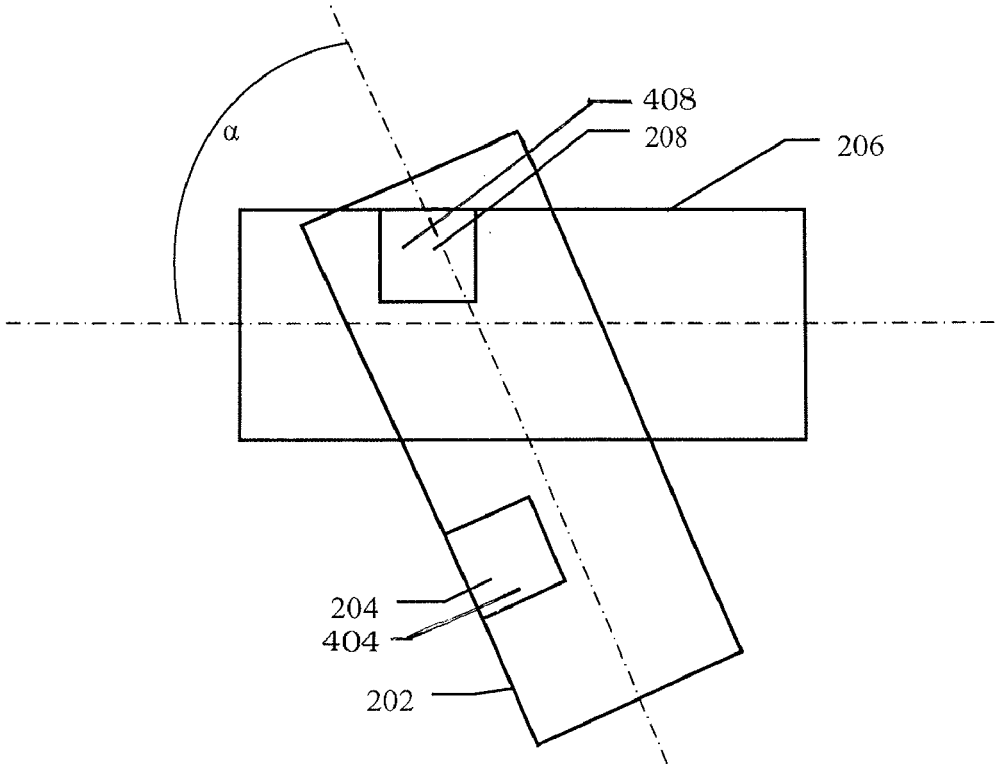
FIG. 5 is a schematic diagram illustrating a waveguide junction in accordance with one embodiment of the present invention.

Alternatively, as seen in FIG. 5, when the angular offset $\alpha$ is substantially in a range from 60° up to 90° the ridges 204, 404 and 208, 408 on both sides of the junction 300, 400 are shifted in opposite directions of the broad walls of the transformer sections.

The linear offset of the centre axes of the transformer sections can be different in the internal (third and fourth) and external (first and second) transformer sections. In one embodiment a second linear offset of the centre axes of the third, 402, and fourth, 406, transformer sections is smaller than the first linear offset, h1. In an alternative embodiment a second linear offset of the centre axes of the third, 402, and fourth, 406, transformer sections is bigger than the first linear offset, h1.

The junction is preferably manufactured from one block of metal in the process of milling by machining from the flange faces. However it is within the contemplation of the invention that alternative methods of machining can also be used. In principle, the component could easily be manufactured as diecast also—from aluminium or even from metallized plastic. In case of milling, the junction exhibits some radii in the corners. However, complete rectangular shapes are also possible—that could be a suitable solution for high volume production by e.g. diecasting with aluminium or silver-plated plastic.

The invention claimed is:

1. A junction for connecting first and second waveguides, the junction comprising:

a first transformer section and a second transformer section, each transformer section including:

a substantially rectangular cross-section, each having a longitudinal symmetry axis and a center axis; and a protruding ridge disposed on respective broad walls such that the protruding ridge associated with the first transformer section is positioned substantially outside the cross section of the second transformer section, and the protruding ridge associated with the second transformer section is positioned substantially outside the cross section of the first transformer section; and an angular offset ($\alpha$) between the respective longitudinal symmetry axes, and a first linear offset (h1) between the respective center axes.

2. The junction of claim 1 wherein the junction comprises a monolithic metal block.

3. The junction of claim 1 further comprising third and fourth transformer sections, and wherein two of the first, second, third, and fourth transformer sections are disposed on each side of the junction.

4. The junction of claim 3 wherein the third transformer section is connected to the first transformer section with no angular offset and no linear offset there between, and wherein the fourth transformer section is connected to the second transformer section with no angular offset and no linear offset there between.

5. The junction of claim 4 wherein dimensions of a third ridge in the third transformer section are greater than dimensions of the protruding ridge associated with the first transformer section, and wherein dimensions of a fourth ridge in the fourth transformer section are greater than dimensions of the ridge associated with the second transformer section.

6. The junction of claim 5 wherein the third transformer section is connected to the fourth transformer section.

7. The junction according of claim 6 wherein the angular offset ($\alpha$) is substantially in a range from 0° to 60°, and wherein each of the first, second, third, and fourth ridges are located substantially at a center of the respective broad walls of the corresponding transformer sections for the angular offset ($\alpha$).

8. The junction according of claim 6 wherein the angular offset ($\alpha$) is substantially in a range from 60° up to 90°, and wherein each of the protruding ridges on both sides of the junction are shifted in directions that are opposite of the respective broad walls of the corresponding transformer sections, for the angular offset ($\alpha$).

9. The junction of claim 6 wherein the cross-sections of all transformer sections have the same dimensions.

10. The junction of claim 6 wherein the third and fourth transformer sections have cross-sectional dimensions that are smaller than corresponding cross-sectional dimensions of the first and second transformer sections.

11. The junction of claim 10 wherein center axes of the third and fourth transformer sections have a second linear offset that differs from the first linear offset (h1).

12. The junction of claim 6 wherein each of the protruding ridges comprise flat tops.

13. The junction of claim 1 further comprising:

a first interface section located between the first transformer section and the first waveguide; and a second interface section located between the second transformer section and the second waveguide.

14. The junction of claim 13 wherein the cross-sections of the first and second interface sections are bigger than corresponding cross-sections of the first and second transformer sections.

* * * * *